US006065760A

United States Patent [19]

Weygandt

[11] Patent Number: 6,065,760

[45] Date of Patent: May 23, 2000

[54] INTERCHANGEABLE SKATE WHEEL BEARING ASSEMBLY

[76] Inventor: James H. Weygandt, 1-5-2 Osugi, Edogawa-ku, Tokyo 132, Japan

[21] Appl. No.: 09/110,552

[22] Filed: Jul. 6, 1998

[51] Int. Cl.[7] ..... A63C 17/00

[52] U.S. Cl. ..... 280/11.19; 280/11.22

[58] Field of Search ..... 280/11.19, 11.2, 280/11.22; 301/5.3, 5.7; 16/46; 384/537, 626

[56] References Cited

U.S. PATENT DOCUMENTS

| | | | |
|---|---|---|---|
| 4,072,373 | 2/1978 | Black | 308/191 |
| 4,135,763 | 1/1979 | Kosono et al. | 301/5.7 |
| 5,271,633 | 12/1993 | Hill | 280/11.22 |
| 5,362,075 | 11/1994 | Szendel | 280/11.22 |
| 5,441,286 | 8/1995 | Pozzobon . | |
| 5,655,784 | 8/1997 | Lee | 280/11.22 |
| 5,655,785 | 8/1997 | Lee | 280/11.22 |
| 5,667,280 | 9/1997 | Hansen | 301/5.3 |
| 5,692,809 | 12/1997 | Hook | 301/5.3 |
| 5,724,284 | 3/1998 | Boyer | 301/5.3 |
| 5,725,284 | 3/1998 | Boyer | 301/5.3 |
| 5,853,226 | 12/1998 | Lee | 301/5.3 |
| 5,901,970 | 5/1999 | Henshaw | 280/11.19 |
| 5,915,703 | 6/1999 | Wrike | 280/11.22 |
| 5,964,537 | 10/1999 | Hill, Jr. | 384/559 |

*Primary Examiner*—Eric Culbreth
*Assistant Examiner*—L. Lum
*Attorney, Agent, or Firm*—Larry J. Guffey

[57] ABSTRACT

The present invention provides apparatus and methods for use in a conventional, in-line skate wheel. These enable one to interchange such a skate wheel's bearing assemblies in order to minimize their weight so as to allow for the wheel's increased operational speeds and performance. In one embodiment of the present invention, an improved, interchangeable bearing assembly comprises a replacement bearing spacer and a pair of cylindrical-shaped sleeves sized to accommodate a replacement bearing that has a smaller, outer diameter than that bearing usually found in the conventional in-line skate bearing assembly.

11 Claims, 5 Drawing Sheets

INTERCHANGEABLE SKATE WHEEL BEARING ASSEMBLY

BACKGROUND OF THE INVENTION

1. Field of the Invention

The present invention generally relates to the wheels and axles of land vehicles. More particularly, this invention relates to roller skate, skateboard in-line skate wheels having an interchangeable bearing assembly that enables a standard skate wheel's bearing assembly to be minimized in weight so as to allow for increased operational speeds and performance.

2. Description of the Related Art

The popularity of in-line skates has grown significantly in recent years. In-line skates are not only being used for recreation and fitness training, their popularity has grown into competitive racing or speed-skating. With this broader use, increasing emphasis has been placed upon the development of higher performance wheels for in-line skates.

Several recent U.S. patents have been directed to providing skate wheels having increased performance capabilities and greater durability. For example, see U.S. Pat. Nos. 5,271,633, 5,655,784, 5,667,280 and 5,692,890. However, few, if any, of the elements of the inventions disclosed in these patents appear to have found their way into general industry use.

Instead, the in-line skate industry has come to be dominated by two types of in-line skate wheels. The first of these is generally identified as the prior art in U.S. Pat. No. 5,362,075, and shown in FIGS. 1 through 3. The second of these differs from the first primarily by using a larger diameter axle with a shorter length, self-centering spacer, and is shown in FIG. 4.

The bearings of the conventional, in-line skate comprise an appreciable part of the weight of the wheel. Such bearings often weigh about 12–15 grams each when the total weight of the entire wheel is only 72–100 grams. In general, such conventional wheels have incorporated hub designs that allow only one size of bearing to be used. This conventional bearing is usually of the type that has static and dynamic load rating capabilities of such a magnitude as to accommodate the heaviest users when they are assumed to be using the in-line skate in such a manner as to impose normal, dynamic loads (e.g., leisurely fitness training, rather than high impact jumping).

This situation presents the opportunity for significantly improving the performance capabilities of such in-line skate wheels if a means can be found to allow the skate user to interchange the conventional bearing for a lighter weight bearing having load ratings which are more closely matched to how the user plans to use the skates.

Despite the prior art directed to improving the performance capabilities of in-line skate wheels, the need exists for an improved means for optimizing the conventional in-line skate wheel's bearing assembly so as to minimize its weight while ensuring that adequate bearing load capabilities are maintained.

SUMMARY OF THE INVENTION

The present invention is generally directed to satisfying the needs set forth above and the problems identified in the prior arts. The problem of how to reduce the weight of a conventional in-line skate wheel's bearings, without sacrificing the skater's requirement for a bearing having an adequate, maximum load rating, is resolved by the present invention.

In accordance with one preferred embodiment of the present invention, the foregoing need can be satisfied by providing an improved, interchangeable bearing assembly for a conventional in-line skate wheel of the type having a hub that encircles the central axis of the wheel, said hub having left and right bearing apertures with a left and a right bearing that are positioned in said left and right hub apertures and a bearing spacer which assists in spacing the bearings apart, wherein the improvement comprises:

a pair of cylindrical-shaped sleeves, each of which is adapted to be inserted into said left and right hub apertures, each of said sleeves having an annular recess to accommodate a replacement bearing that has a smaller, outer diameter than that bearing usually found in the conventional in-line skate bearing assembly.

In another preferred embodiment, the present invention is seen to take the form of a method of providing for the interchanging of the bearing assembly in a conventional, in-line skate wheel in order to enable the wheel's bearing assembly to be minimized in weight so as to allow for increased operational speeds and performance, wherein the conventional in-line skate wheel is of the type having a hub that encircles the central axis of the wheel, said hub having left and right bearing apertures with a left and a right bearing that are positioned in said left and right hub apertures and a bearing spacer which assists in spacing the bearings apart, the method comprising the steps of:

removing the bearings from the conventional bearing assembly, inserting a left and right sleeve into the hub's bearing aperture, each said sleeve being cylindrical-shaped and having an annular recess to accommodate a bearing that has a smaller, outer diameter than that bearing usually found in the conventional in-line skate bearing assembly, selecting interchangeable left and right bearings so that they frictionally fit into said sleeve annular recesses, and inserting said smaller, outer diameter bearing into said sleeves and reassembling the bearing assembly.

This new and improved, interchangeable bearing assembly is seen to achieve its object of providing the capability to enable a conventional wheel's bearing assembly to be minimized in weight so as to allow for increased operational speeds and performance. Additionally, it should be noted that this capability has been achieved in such a manner so as to allow in-line skate wheel manufacturers to continue to maintain an industry-standard size wheel hub.

Other objects and advantages of this invention will become readily apparent as the invention is better understood by reference to the accompanying drawings and the detailed description that follows.

DESCRIPTION OF THE PREFERRED EMBODIMENT

Figure 1:
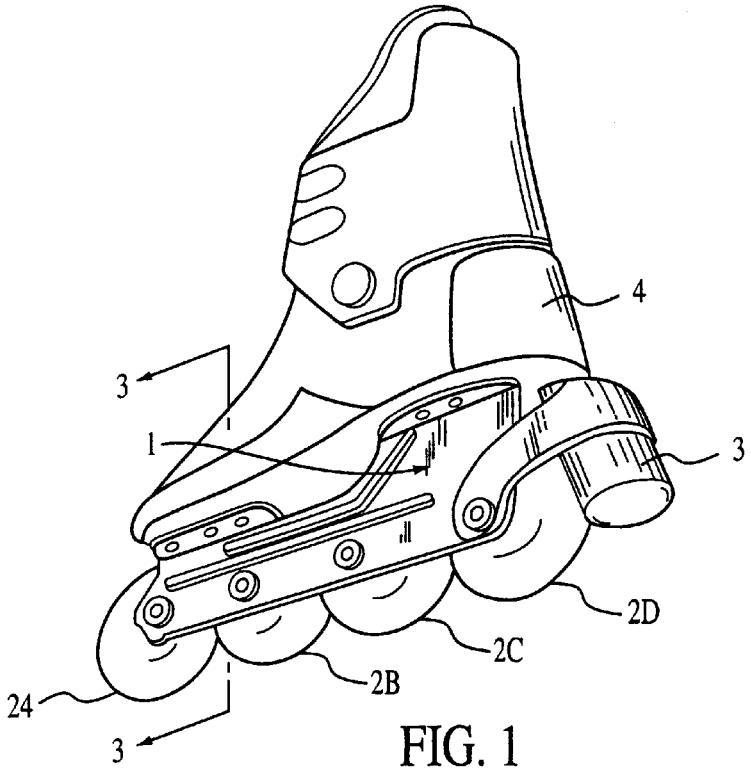
FIG. 1 PRIOR ART
FIG. 1 is a perspective view showing the essential components of the conventional in-line skate.
Figure 2:
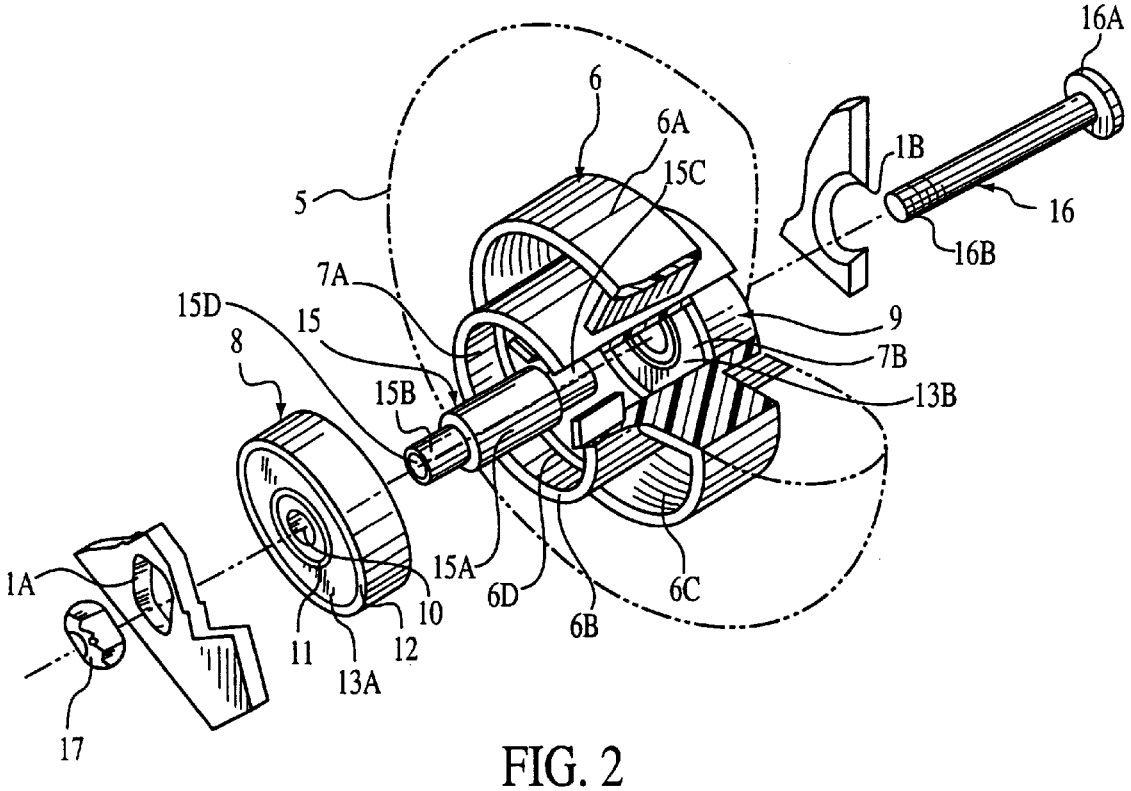
FIG. 2 PRIOR ART
FIG. 2 is an exploded, partially cut-away view of a first version of the wheel and bearing assembly of the conventional in-line skate shown in FIG. 1.
Figure 3:
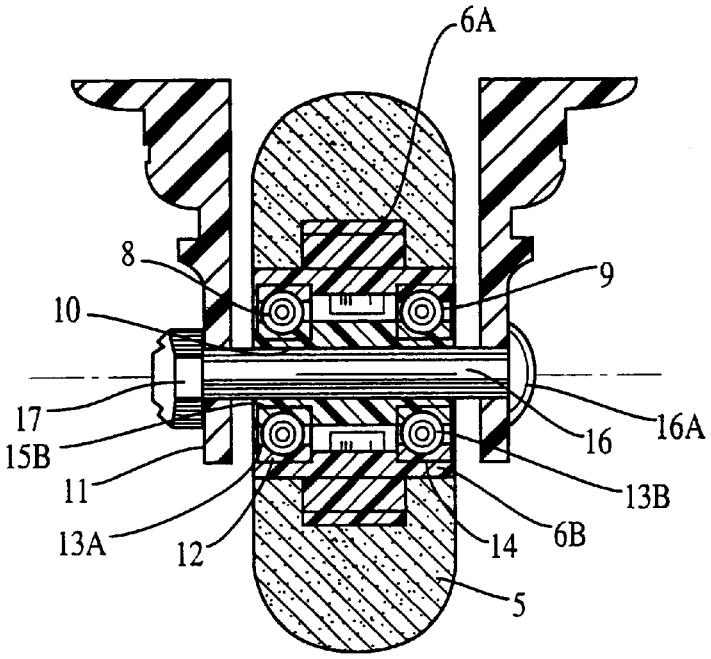
FIG. 3 PRIOR ART
FIG. 3 is an elevated, cross-sectional end view of a first version of the wheel and bearing assembly, taken along line 3—3 of FIG. 1.

Referring now to the drawings wherein are shown preferred embodiments and wherein like reference numerals designate like elements throughout, there is shown in FIGS. 1 through 3 one of the two versions of the conventional in-line skate wheel and bearing assemblies that have come to dominate the in-line skate market.

As shown in FIG. 1, this version of the conventional in-line skate wheel and bearing assembly includes an elongated, light-weight elastic frame 1 to which a plurality of substantially identical in-line skate wheels, 2A, 2B, 2C and 2D are rotatably mounted. The frame carries a brake assembly 3 at the rear end thereof and is mounted to a boot 4 which provides protection and support to the foot and ankle of the skater.

As illustrated in FIGS. 2 and 3, each wheel has an outer tire member 5 formed of resilient, polyurethane material which is molded about and closely encapsulates the outer portion of a central hub 6 which rotates about the central axis of the wheel. The hub is molded of plastic or other suitable synthetic material and has an outer, substantially rigid ring 6A which is concentric with a smaller inner ring 6B. These substantially rigid rings are interconnected by a plurality of substantially rigid vanes 6C which are molded integrally with the hub. The inner ring has left and right bearing apertures 7A and 7B into which substantially identical left and right bearings 8 and 9 are received and frictionally retained.

As best shown in FIG. 3, bearings 8 and 9 each have a number of subcomponents, namely: a central axle bore 10, an inner race 11, an outer race, 12, a flat, annular-shaped, outer face 13A covering a ball bearing 14 and a flat, annular-shaped, inner face 13B, in which the inner face is positioned in the hub adjacent the hub's bearing abutment 6D. Each wheel is provided with a bearing spacer 15 having a raised central shoulder 15A, which abuts against the inner races of bearings 8 and 9 to space the bearings apart. The shoulder has a length substantially equal to the distance between the bearings when they are properly positioned in the bearing apertures of the hub. Cylindrical end sections 15B and 15C of the bearing spacer are of a suitable diameter and length to permit them to be inserted within and frictionally engage the inner races of the bearings so as to locate the axle bore of the inner race from axle 16 which extends through the bearing spacer bore 15D and between axle apertures 1A and 1B in the frame.

The axle has a wide head 16A and a threaded end 16B. A nut 17 with an integral lock nut mechanism is threadably received on axle end 16B. The head and nut collectively comprise a clamping means by which the bearing spacer and the inner races of the bearing may be tightly retained on the skate frame, while the outer race of each bearing rotates freely about the axle to permit easy and fast rotation of the wheels.

Figure 4:
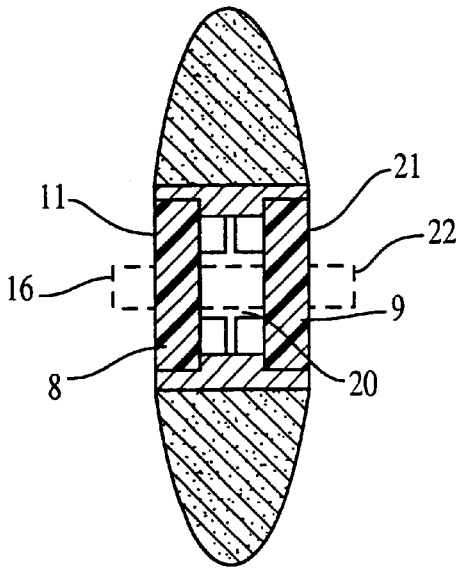
FIG. 4 PRIOR ART
FIG. 4 is a cross-sectional view of a second version of the wheel and bearing assembly of the conventional in-line skate showing a larger diameter axle with a self-centering spacer.

A second version of the conventional in-line skate wheel and bearing assembly is shown in a cross-sectional view in FIG. 4. It differs from that shown in FIGS. 2–3 by having a larger diameter axle (i.e., 8 versus 7 mm) and uses a self-centering bearing spacer 20 whose length is such that its ends 21 abut against the inner races of the bearings 8 and 9 to space the bearings apart. In this version, the central axle bore 10 of a bearing is seen to frictionally engage the outer surface 22 of the axle 16.

Figure 5:
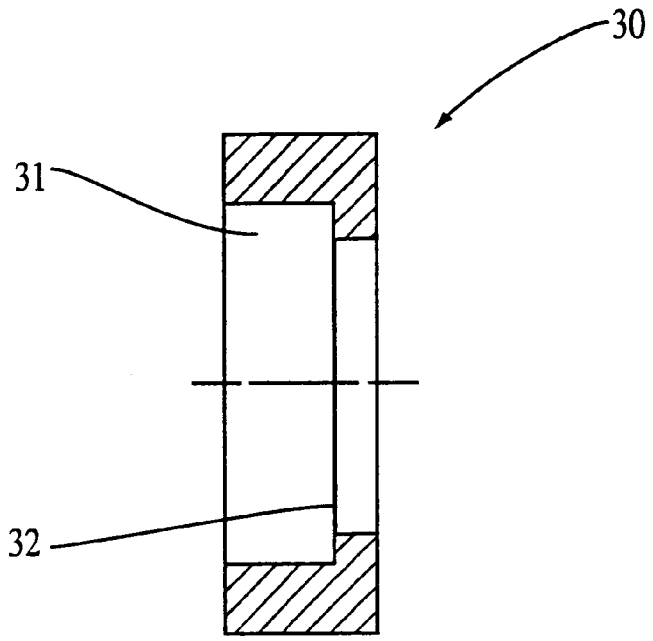
FIG. 5 is a cross-sectional view of one embodiment of the present invention showing a bearing sleeve which is to be inserted into the conventional wheel's hub apertures.

FIG. 5 provides a cross-sectional view showing one embodiment of the present invention that is for use with the first version of the previously described conventional in-line skate wheel and bearing assembly. It comprises a bearing sleeve 30 which is to be inserted into the conventional wheel's hub apertures 7A and 7B. The sleeve 30 is seen to be cylindrical-shaped and to have an annular recess 31, whose depth is defined by an abutment 32, wherein the depth and diameter of such recess 31 are such as to accommodate a bearing that has a smaller, outer diameter and a smaller width than that bearing usually found in the conventional in-line skate bearing assembly.

As an example of the weight saving that can be achieved by the use of such a sleeve and the choice of a smaller outer diameter and smaller width bearing, it can be noted that the most frequently used bearing in the conventional in-line wheel bearing assembly is a metric series 608 bearing having an outer diameter of approximately 22 millimeters and a width of approximately 7.0 millimeters, with a weight of approximately 12 grams. Replacing this bearing with the metric series 688 bearing which weighs approximately 3.2 grams, the required sleeve is seen to have a recess having a diameter of approximately 16 millimeters and a width of approximately 5.0 millimeters. Using aluminum Al 6061 T6 from which to machine this sleeve, the weight of the bearing assembly is seen to be reduced by approximately 50%, while using most engineering plastics yields weight savings of nearly 63%.

While the use of the 688 bearing in place of the 608 bearing would result in static and dynamic bearing load ratings of approximately 50% to 60% of those of the 608 bearing, this would not, in most cases, appreciably affect the bearing assembly's range of safe operability since this conventional bearing assembly is designed to be used safely by the heaviest skaters under high stress conditions.

Figure 6:
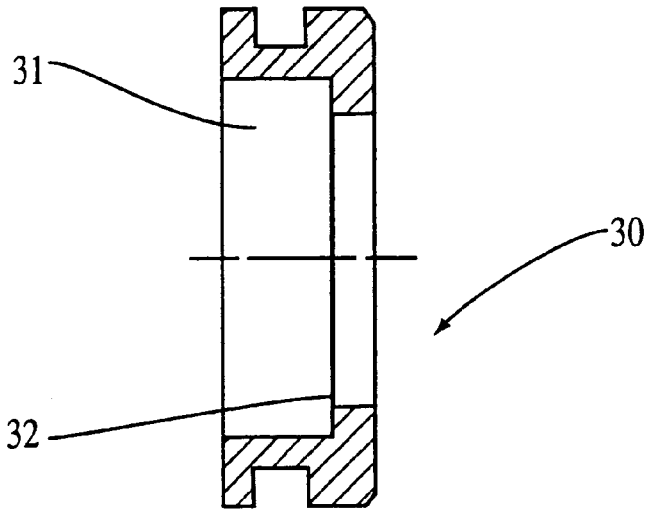
FIG. 6 is a cross sectional view showing the essential elements of a second embodiment of a bearing sleeve which has further material removed from the sleeve so as to further minimize its weight.

FIG. 6 is a cross sectional view showing the essential elements of a second embodiment of a bearing sleeve as generally shown in FIG. 5 which has further material removed from the sleeve so as to further minimize its weight.

Figure 7:
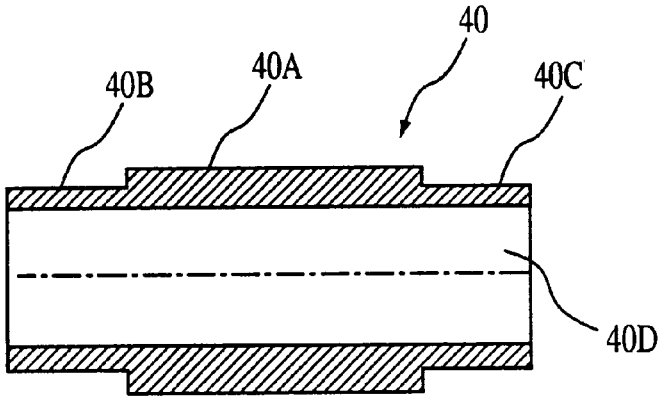
FIG. 7 is a cross sectional view showing one embodiment of a replacement bearing spacer whose dimensions are such as to accommodate a smaller outer diameter and smaller width bearing.

FIG. 7 is a cross sectional view showing one embodiment of a replacement bearing spacer 40 whose dimensions are such as to accommodate a smaller outer diameter and smaller width bearing. This replacement bearing spacer 40 has a raised central shoulder 40A, which abuts against the inner races of replacement bearings to space the bearings apart. This shoulder has a length substantially equal to the distance between the bearings when they are properly positioned in the sleeves affixed in the hub apertures. Cylindrical end sections 40B and 40C of the replacement bearing spacer are of a suitable diameter and length to permit them to be inserted within and frictionally engage the inner races of the smaller bearings so as to locate the axle bore of the inner race from axle which extends through the replacement bearing spacer bore 40D.

Figure 8:
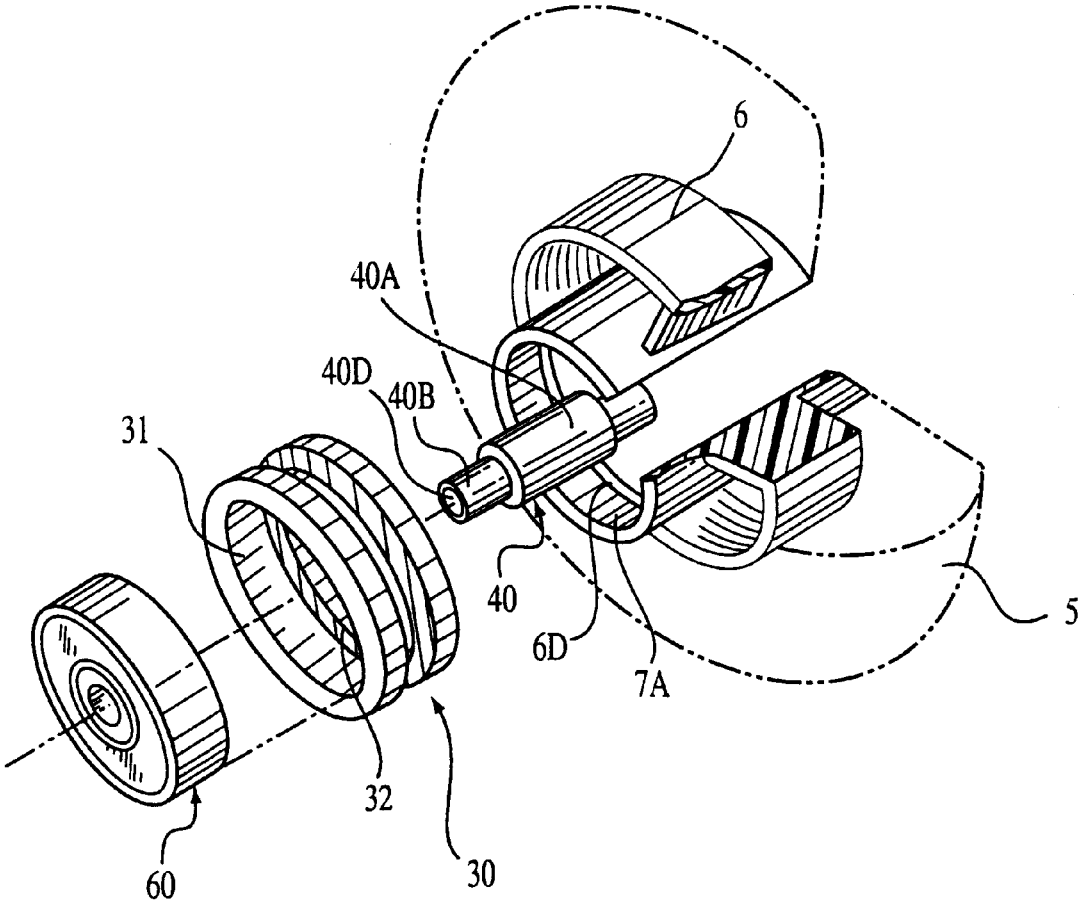
FIG. 8 is an exploded, partially cut-away view of some of the primary components on one side of a wheel and bearing assembly that employs the embodiments of the present invention previously described in FIGS. 6 and 7.

FIG. 8 is an exploded, partially cut-away view of some of the primary components on one side of a wheel and bearing assembly that employs the embodiments of the present invention previously described in FIGS. 6 and 7 and which allows for the use of a replacement bearing 60 that has a smaller, outer diameter and a smaller width than that bearing usually found in the conventional in-line skate bearing assembly.

For the second version of the conventional in-line skate wheel and bearing assembly that was previously shown in a cross-sectional view in FIG. 4, one embodiment of the present invention again comprises a bearing sleeve 30 which is to be inserted into the conventional wheel's hub apertures 7A and 7B. The sleeve 30 is seen to be cylindrical-shaped and to have an annular recess 31, whose depth is defined by an abutment 32, wherein the depth and diameter of such recess 31 are such as to accommodate a bearing that has a smaller, outer diameter and a smaller width than that bearing usually found in the conventional in-line skate bearing assembly.

Figure 9:
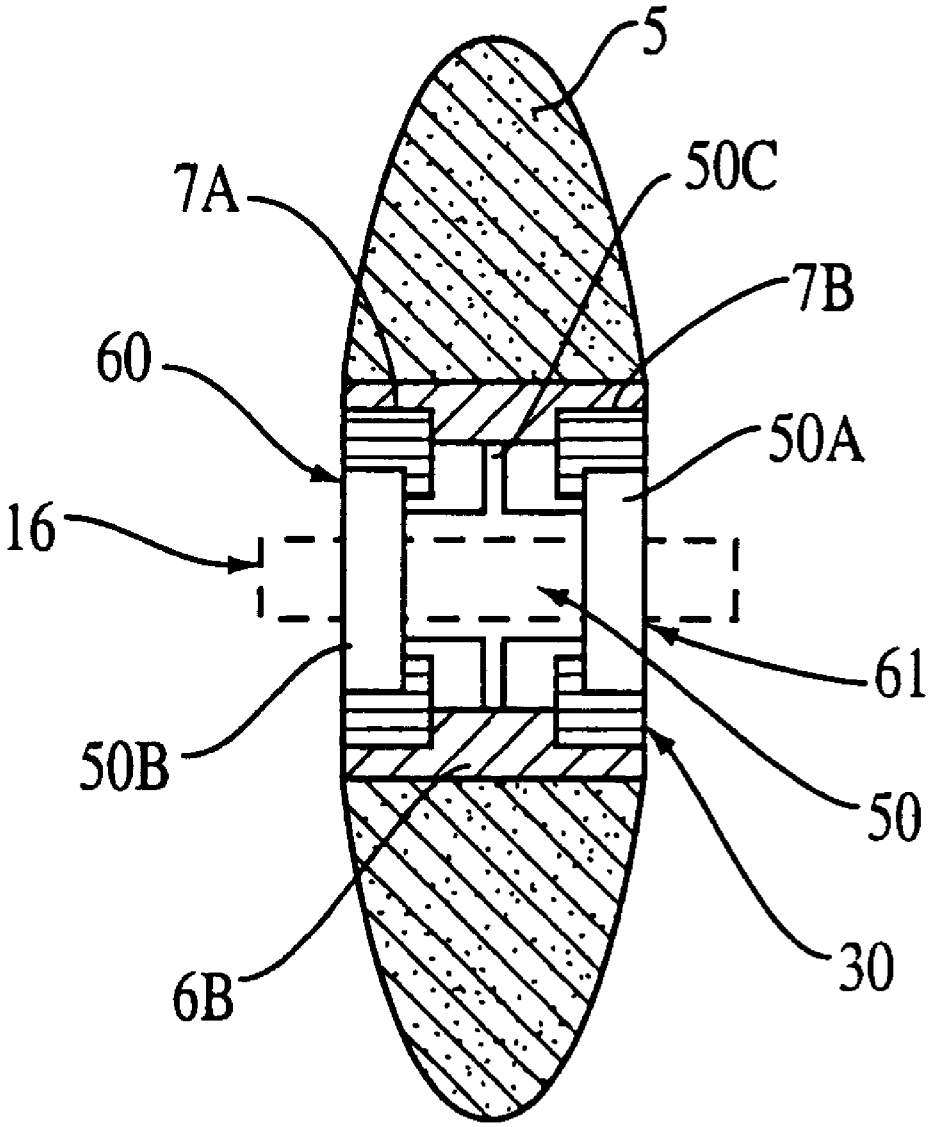
FIG. 9 is a cross sectional view showing one embodiment of the combination of the smaller bearing with the a bearing sleeve and a replacement, self-centering bearing spacer.

Because of the bearing's smaller width, the conventional self-centering bearing for this version of the conventional wheel must be replaced with a replacement spacer having longer length. FIG. 9 is a cross sectional view showing one embodiment of this combination of the smaller bearing with the a bearing sleeve 30 and a replacement, self-centering bearing spacer 50. This replacement, self-centering bearing spacer 50 has cylindrical end sections 50A and 50B, which abut against the inner races of replacement bearings 60 and 61 to space the bearings apart, and a central disc-like protuberance 50C. This spacer's length is substantially equal to the distance between the replacement bearings when they are properly positioned in the sleeves 30 affixed in the hub apertures 7A and 7B.

It thus will be appreciated that a new and improved, interchangeable bearing assembly has been disclosed that achieves its object of providing the capability to enable a conventional wheel's bearing assembly to be minimized in weight so as to allow for increased operational speeds and performance.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

I claim:

1. An improved, interchangeable bearing assembly for a skate wheel (2) having a hub (6) that encircles the central axis of the wheel (2), said hub (6) having left (7A) and right (7*b*) apertures, each aperture adapted to accommodate a bearing (8,9) whose diameter and width are substantially equivalent to that of a series 608 bearing, and a bearing spacer (15) adapted for use with said bearing (8,9), wherein the improvement comprises:

a pair of cylindrical-shaped sleeves (30), each sleeve adapted to be inserted into each aperture, and having an annular recess (31) to accommodate a replacement bearing (60) having a smaller, outer diameter than that of said series 608 bearing.

2. An improved, interchangeable bearing assembly as recited in claim 1, wherein when said replacement bearing (60) has also a smaller width than that of a series 608 bearing and where said bearing spacer (15) having a raised central shoulder (15A) and cylindrical end sections (15B, 15C), said assembly further comprising:

said sleeve having an abutment (32) defining a depth of said annular recess (31), and a replacement bearing spacer (40) having a central shoulder section (40A) with a length greater than that of said raised central section (15A) of said bearing spacer (15) for use with a series 608 bearing.

3. An improved, interchangeable bearing assembly as recited in claim 1, wherein said replacement bearing (60) has also a smaller width than that of a series 608 bearing and where said bearing spacer is self-centering said assembly further comprising:

said sleeve having an abutment (32) defining a depth of said annular recess (31), and a replacement, self-centering bearing spacer (50) having a length greater than that of said self-centering bearing spacer for use with said series 608 bearing.

4. An improved, interchangeable bearing assembly as recited in claim 2, wherein said replacement bearing (60) is a series 688 bearing.

5. An improved, interchangeable bearing assembly as recited in claim 3, wherein said replacement bearing (60) is a series 688 bearing.

6. A method of providing for interchanging of a bearing assembly in a skate wheel (2) in order to minimize weight of said bearing assembly so as to allow for increased operational speeds and performance, wherein the skate wheel (2) having a hub (6) that encircles the central axis of the wheel (2), said hub (6) having left (7A) and right (7B) apertures, each aperture adapted to accommodate a bearing (8,9) whose diameter and width are substantially equivalent to that of a series 608 bearing, and a bearing spacer (15) adapted for use with said bearings (8,9), the method comprising the steps of:

removing the bearings (8, 9) from the bearing assembly, inserting a sleeve (30) respectively into each aperture of said hub, each sleeve having a cylindrical shape, and an annular recess (31) which accommodates a replacement bearing (60) with a frictional fit, said replacement bearing having an outer diameter smaller than that of said series 608 bearing, and inserting a replacement bearing (60) into each said sleeve (30).

7. A method of providing for interchanging of a bearing assembly in a skate wheel as recited in claim 6, wherein when said replacement bearing (60) is also of a smaller width than that of said series 608 bearing, and where said bearing spacer (15) having a raised central shoulder (15A) and cylindrical end sections (15B, 15C), and where said sleeve having an abutment (32) defining a depth of said annular recess (31), said method further comprising the step of:

replacing said bearing spacer (15) with a replacement bearing spacer (40) having a central shoulder section (40A) with a length greater than that of said raised central section (15A) of the bearing spacer (15) for use with said series 608 bearing.

8. A method of providing for interchanging of a bearing assembly in a skate wheel as recited in claim 6, wherein when said replacement bearing (60) has also a smaller width than that of a series 608 bearing, and where said bearing spacer is self-centering, said method further comprising the step of:

replacing said self-centering, bearing spacer with a replacement self-centering bearing spacer (50) having a length greater than that of said self-centering bearing spacer for use with said series 608 bearing.

9. A method of providing for interchanging of a bearing assembly in a skate wheel as recited in claim 7, wherein said replacement bearing (60) is a series 688 bearing.

10. A method of providing for interchanging of a bearing assembly in a skate wheel as recited in claim 8, wherein:

said replacement bearing (60) is a series 688 bearing.

11. An improved, interchangeable bearing assembly for a skate wheel (2) having a hub (6) that encircles the central axis of said wheel (2), said hub (6) having left (7A) and right (7B) apertures, each aperture adapted to accommodate a bearing (8,9) whose diameter and width are substantially equivalent to that of a series 608 bearing, and a bearing spacer (15) adapted for use with said bearings (8,9), wherein the improvement comprises:

a pair of cylindrical-shaped sleeves (30), each sleeve adapted to be inserted into each aperture, and having an annular recess (31) to accommodate a replacement bearing (60) having a smaller diameter than that of said series 608 bearing for reducing weight of said bearing assembly.

* * * * *